US008656528B2

(12) United States Patent
Perelman et al.

(10) Patent No.: US 8,656,528 B2
(45) Date of Patent: Feb. 25, 2014

(54) PATIENT TRANSFER BOARD, TRANSFER ASSEMBLY, AND A METHOD OF MANUFACTURING A TRANSFER BOARD

(75) Inventors: Benjamin Perelman, Brookfield, WI (US); Liyong Wu, Waukesha, WI (US); Roman I. Dachniwskyj, Pewaukee, WI (US); Peter S. Crandall, Oconomowoc, WI (US); Almos A. Elekes, Whitefish Bay, WI (US); Kevin R. Anderson, Salt Lake City, UT (US); Christopher F. Johnson, Bountiful, UT (US); Andrew C. Johnson, North Salt Lake City, UT (US); Michael R. Koger, Commerce City, CO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/489,114

(22) Filed: Jun. 5, 2012

(65) Prior Publication Data

US 2013/0318707 A1 Dec. 5, 2013

(51) Int. Cl.
*A47C 21/06* (2006.01)

(52) U.S. Cl.
USPC ..... 5/81.1 HS; 5/81.1 R; 5/601; 5/83.1

(58) Field of Classification Search
USPC ..... 5/81.1 R, 81.1 HS, 83.1, 601, 611, 615; 378/209
See application file for complete search history.

(56) References Cited

U.S. PATENT DOCUMENTS

| | | | | |
|---|---|---|---|---|
| 3,786,523 | A | 1/1974 | Sele | |
| 3,948,344 | A | 4/1976 | Johnson et al. | |
| 4,259,756 | A | 4/1981 | Pace | |
| 4,567,894 | A | 2/1986 | Bergman | |
| 5,611,638 | A * | 3/1997 | Dorr et al. | 403/327 |
| 5,737,781 | A | 4/1998 | Votel | |
| 6,205,347 | B1 | 3/2001 | Morgan et al. | |
| 6,484,332 | B2 | 11/2002 | Korver, II et al. | |
| 6,640,364 | B1 | 11/2003 | Josephson et al. | |
| 6,718,571 | B2 | 4/2004 | Bartels | |
| 6,854,140 | B2 | 2/2005 | Bartels et al. | |
| 7,131,769 | B2 | 11/2006 | Vezina | |
| 7,228,579 | B2 * | 6/2007 | Tidwell | 5/624 |
| 7,412,027 | B2 | 8/2008 | Yakubovsky et al. | |
| 7,490,377 | B2 * | 2/2009 | Ahlman | 5/81.1 R |
| 7,540,043 | B2 | 6/2009 | Stackley et al. | |
| 7,869,858 | B2 | 1/2011 | Calderon et al. | |
| 8,046,851 | B2 | 11/2011 | Ahlman | |
| 2005/0102749 | A1 * | 5/2005 | Heimbrock | 5/81.1 HS |
| 2007/0020070 | A1 * | 1/2007 | Venkatachalapathy | 414/401 |
| 2007/0039101 | A1 | 2/2007 | Luginbuhl et al. | |
| 2010/0071127 | A1 | 3/2010 | Koger et al. | |

FOREIGN PATENT DOCUMENTS

| | | |
|---|---|---|
| WO | WO2005070295 | 8/2005 |

* cited by examiner

*Primary Examiner* — William Kelleher
*Assistant Examiner* — Richard G Davis
(74) *Attorney, Agent, or Firm* — The Small Patent Law Group; Dean D. Small

(57) ABSTRACT

A patient transfer board including an elongated board body that extends lengthwise along a longitudinal axis between leading and trailing ends of the board body. The transfer board has a top side and an underside of the board body. The underside includes first and second side edges that extend along the longitudinal axis. The underside includes alignment slots having respective openings at the first side edge. The alignment slots are defined by interior sidewalls. The alignment slots are configured to receive reference elements of the patient table through the respective openings when the transfer board is moved in a lateral direction that is generally transverse to the longitudinal axis. The sidewalls are configured to engage the corresponding reference elements and direct the transfer board toward a designated position.

19 Claims, 7 Drawing Sheets

PATIENT TRANSFER BOARD, TRANSFER ASSEMBLY, AND A METHOD OF MANUFACTURING A TRANSFER BOARD

BACKGROUND

The subject matter disclosed herein relates generally to a transfer board for moving a patient and, more particularly, to a transfer board that positions the patient at a designated location for medical imaging or therapy.

Patients can be imaged using a wide variety of different imaging technologies. Medical imaging systems may include magnetic resonance imaging (MRI), computer tomography (CT), positron emission tomography (PET), single photon emission computed tomography (SPECT), x-ray imaging, and others. Imaging systems typically include field-of-views (FOVs) where a patient is positioned to be imaged. On some occasions, a patient is imaged using more than one modality. Image data from the different modalities (e.g., PET, CT, MRI, SPECT) can be combined to provide useful information to a doctor or other qualified individual. For instance, two different images can be co-registered to generate a composite image in which the anatomical structures in the different medical images have been aligned.

In some applications, it may be necessary to move the patient from a first imaging system (e.g., MR imaging system) to a second imaging system (PET/CT imaging system). For example, a transporter carrying a transfer board with the patient immobilized thereon may be moved from one imaging system to the next. The transfer board is configured to slide into the imaging systems while the patient lies on the transfer board. In many cases, the transporter is docked to an end of a table of a first imaging system. The transfer board is moved longitudinally along the table until the patient is positioned within the FOV of the first imaging system. After an imaging session, the patient may be moved back onto the transporter and then moved to the second imaging system.

However, medical imaging systems such as those described above may have certain challenges or limitations. For example, when the patient is transported from one imaging system to the next, the patient may move and/or the transfer board may be positioned at different locations in the imaging systems. When this occurs, it may be more difficult to co-register the images. Also, medical imaging systems that include docking stations typically require the transporter and the table to be positioned end-to-end in order for the transporter to be docked to the table. As such, the room where the imaging system is located must have enough space to accommodate the length of the transporter added to the length of the table. This total length can be large and, consequently, restrict the configuration of the room. Moreover, in order to save resources and use staff more efficiently, it is desirable to have only one individual transfer a patient onto the different imaging systems. However, if a patient is very heavy, it may be difficult for only one individual to transfer the patient by himself or herself.

BRIEF DESCRIPTION

In one embodiment, a patient transfer board is provided that includes an elongated board body that extends lengthwise along a longitudinal axis between leading and trailing ends of the board body. The transfer board also includes a top side of the board body that is configured to face and hold a patient during a medical imaging or therapy session. The transfer board also including an underside of the board body that is configured to face a patient table during the session.

The underside includes first and second side edges that extend along the longitudinal axis. The underside includes alignment slots having respective openings at the first side edge. The alignment slots are defined by interior sidewalls. The alignment slots are configured to receive reference elements of the patient table through the respective openings when the transfer board is moved in a lateral direction that is generally transverse to the longitudinal axis. The sidewalls are configured to engage the corresponding reference elements and direct the transfer board toward a designated position.

In another embodiment, a patient transfer assembly is provided that includes an elongated board body extending lengthwise along a longitudinal axis between leading and trailing ends of the board body. The board body includes a gas port and a conduit that is fluidicly coupled to the gas port. The board body also includes a top side that is configured to face and hold a patient during a medical imaging or therapy session. The board body also includes an underside that is configured to face a patient table during the session. The underside includes a support chamber that opens to the patient table and an alignment slot having an opening. The alignment slot is configured to receive a reference element of the patient table through the opening when the transfer board is moved in a lateral direction that is generally transverse to the longitudinal axis. The transfer assembly also includes an inflatable membrane located within the support chamber and fluidicly coupled to the gas port. The inflatable membrane has an inlet and a reservoir. The inflatable membrane is configured to inflate when a flow of air is provided to the reservoir.

In yet another embodiment, a method of manufacturing a patient transfer board. The method includes providing a transfer board having an elongated board body that extends lengthwise along a longitudinal axis. The board body includes a gas port and a conduit that is fluidicly coupled to the gas port. The board body has a top side and an underside. The underside is configured to face a patient table during the session. The underside includes a support chamber that opens to the patient table and an alignment slot having an opening. The alignment slot is defined by an interior sidewall. The alignment slot is configured to receive a reference element of the patient table through the opening when the transfer board is moved in a lateral direction that is generally transverse to the longitudinal axis. The method also includes inserting an inflatable membrane into the support chamber. The inflatable membrane has an inlet and a reservoir. The inflatable membrane is configured to inflate when a flow of air is provided to the reservoir. The method also includes fluidicly coupling the inflatable membrane to the conduit so that the inflatable membrane is fluidicly coupled to the gas port.

DETAILED DESCRIPTION

The foregoing summary, as well as the following detailed description of certain embodiments, will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1:
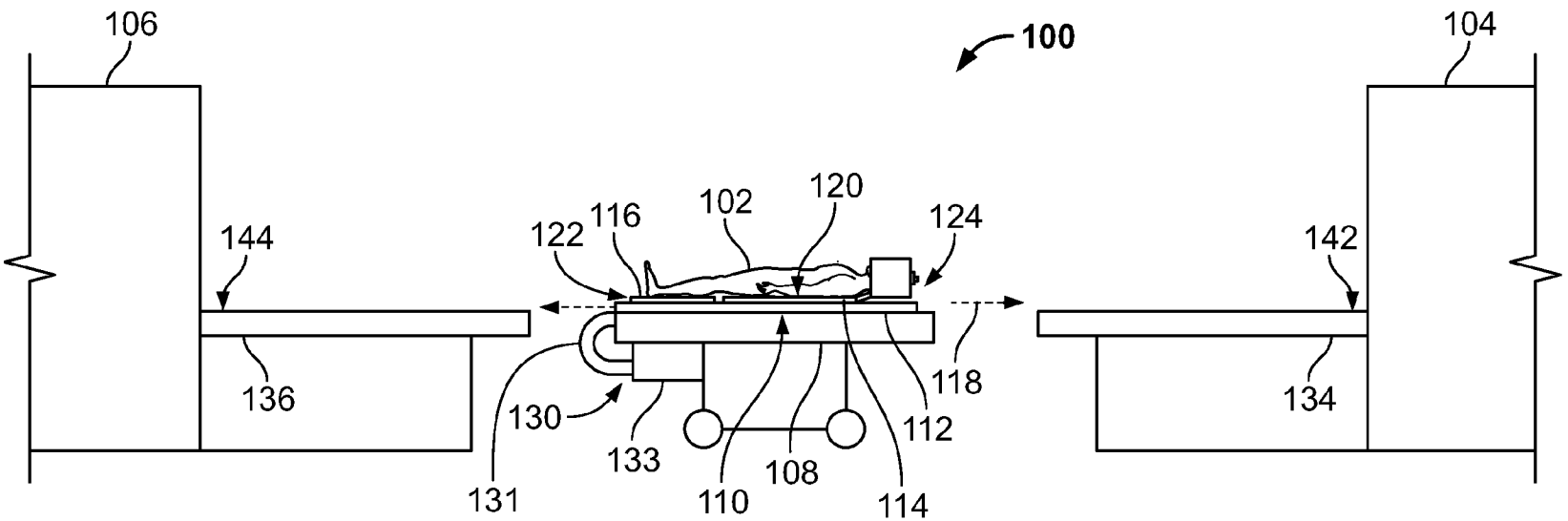
FIG. 1 is a side view showing first and second medical imaging systems and a transporter having a patient transfer board formed in accordance with one embodiment.

FIG. 1 is a side view of a medical transporter 100 formed in accordance with one embodiment that is used to transfer a patient 102 between different imaging systems, such as first and second imaging systems 104, 106. Only representative portions of the imaging systems 104, 106 and the transporter 100 are shown in FIG. 1. The transporter 100 includes a transporter base 108 and a transfer assembly 110. In some embodiments, the transporter base 108 may be a detachable table that is part of one of the imaging systems 104, 106. For example, the imaging system 104 may be an MR imaging system and the transporter base 108 may be a detachable table that is part of the MR imaging system. The transporter base 108 is configured to hold at least portions of the transfer assembly 110 when the transfer assembly 110 is moved between the imaging systems 104, 106. The imaging systems 104, 106 include patient (or imaging) tables 134, 136, respectively, that are configured to receive and support the transfer board 114. In some embodiments, the patient tables 134, 136 may also be configured to hold base inserts as described herein.

In an exemplary embodiment, the transfer assembly 110 includes a base insert 112 and a transfer board 114. The transfer board 114 is configured to be removably mounted onto the base insert 112, which, in turn, may be mounted to a transporter surface. As will be described in greater detail below, the transfer board 114 and the base insert 112 may have complementary structural features that are used to position the transfer board 114 at a designated location. In the illustrated embodiment, the base insert 112 is removably coupled to the transporter base 108. However, in alternative embodiments, the base insert 112 may be integrally formed with the transporter base 108 such that the base insert 112 is not readily separable.

The transfer board 114 includes an elongated board body 116 having a trailing end 122 and a leading end 124 with a longitudinal axis 118 extending therebetween. The board body 116 has a patient surface 120 that extends along the longitudinal axis 118. The board body 116 is configured to have a patient lie directly over the patient surface 120 during imaging or therapy sessions. Although not shown, the board body 116 also includes a bottom surface that interfaces with the base insert 112.

In various embodiments, the transfer board 114 is configured to slide along the base insert 112 in a substantially lateral direction, which is a direction that is generally transverse (e.g., perpendicular) to the longitudinal axis 118. The lateral sliding may be aided by different types of surfaces that reduce frictional forces and/or different types of transfer mechanisms. For instance, in particular embodiments, the transporter 100 may include a pneumatic system 130. The pneumatic system 130 includes a conduit 131 (e.g., hose, pipe, and the like) and an air blower 133. As will be described in greater detail below, the pneumatic system 130 may provide gas (e.g., pressurized air) between the transfer board 114 and the base insert 112 to reduce the friction therebetween. The pneumatic system 130 may facilitate sliding the transfer board 114 to designated locations. The designated locations may be particular locations on the transporter 100 and the patient tables 134, 136. For example, when the transporter 100 is located alongside one of the patient tables 134 or 136, the transfer board 114 may move (e.g., slide) in a lateral direction onto the patient table. The transfer board 114 may be directed to the designated location by features of the patient table.

The first and second imaging systems 104, 106 may be any type of imaging system including a multi-modality imaging system. In an exemplary embodiment, the imaging system 104 is a Magnetic Resonance (MR) imaging system and the imaging system 106 is a dual-modality imaging system that is capable of Positron Emission Tomography (PET) imaging and Computed Tomography (CT) imaging in a common gantry. However, the imaging system 106 may be other types of imaging systems, including X-Ray radiography, fluoroscopy, Single Photon Emission Computed Tomography (SPECT) and/or any other type of imaging modality that is capable of generating images of a region of interest (ROI) of a patient. Generally, embodiments described herein may be used for various purposes with multiple imaging systems in which one of the imaging systems is an MR imaging system. In particular embodiments, the imaging systems 104, 106 are for imaging human subjects. However, the imaging systems 104, 106 may also be used for veterinary purposes. As used herein, the term "patient" may refer to a human patient or an animal.

Moreover, the transporter 100, including the transfer board 114, is not limited to transferring a patient between different imaging systems. The transporter 100 and the transfer board 114 may be suitable for any purpose in which it is desired to transfer a patient. For example, the transporter 100 and the transfer board 114 may be configured to transfer a patient to a therapy-providing system, such as a system that applies radiation.

The patient tables 134, 136 have table surfaces 142, 144, respectively, that are configured to receive the transfer board 114 and, optionally, a base insert. In some cases, the patient tables 134, 136 are capable of imaging the patient without the transfer assembly 110. The patient tables 134, 136 are configured to permit the transfer board 114 to slide onto the patient table 134, 136 or, more particularly, onto table surfaces 142, 144. The table surfaces 142, 144 may slidably engage the transfer board 114. To this end, the patient tables 134, 136 and the transporter 100 are configured relative to each other so that the transfer board 114 may be smoothly transferred to the table surface 142, 144.

As shown, the transfer board 114 can be a low-profile accessory that is configured to be mounted and removably secured to the patient tables 134, 136 and the transporter 100. As used herein, the term "removable" when used to modify "position," "couple," "engage," "mount," or "secure" means the components may be readily separated without destroying or significantly damaging either component. Two components are readily separable in various embodiments when the components can be separated without significant effort and within a reasonable period of time for its intended use. For example, it may be necessary for an operator of the imaging systems 104, 106 or other individual to slidably mount or demount the transfer board 114 multiple times within a day or shift. Although not shown in FIG. 1, the transfer board 114 may permit a removable RF coil to be positioned with respect to the patient 102 without requiring the patient 102 to move.

Figure 2:
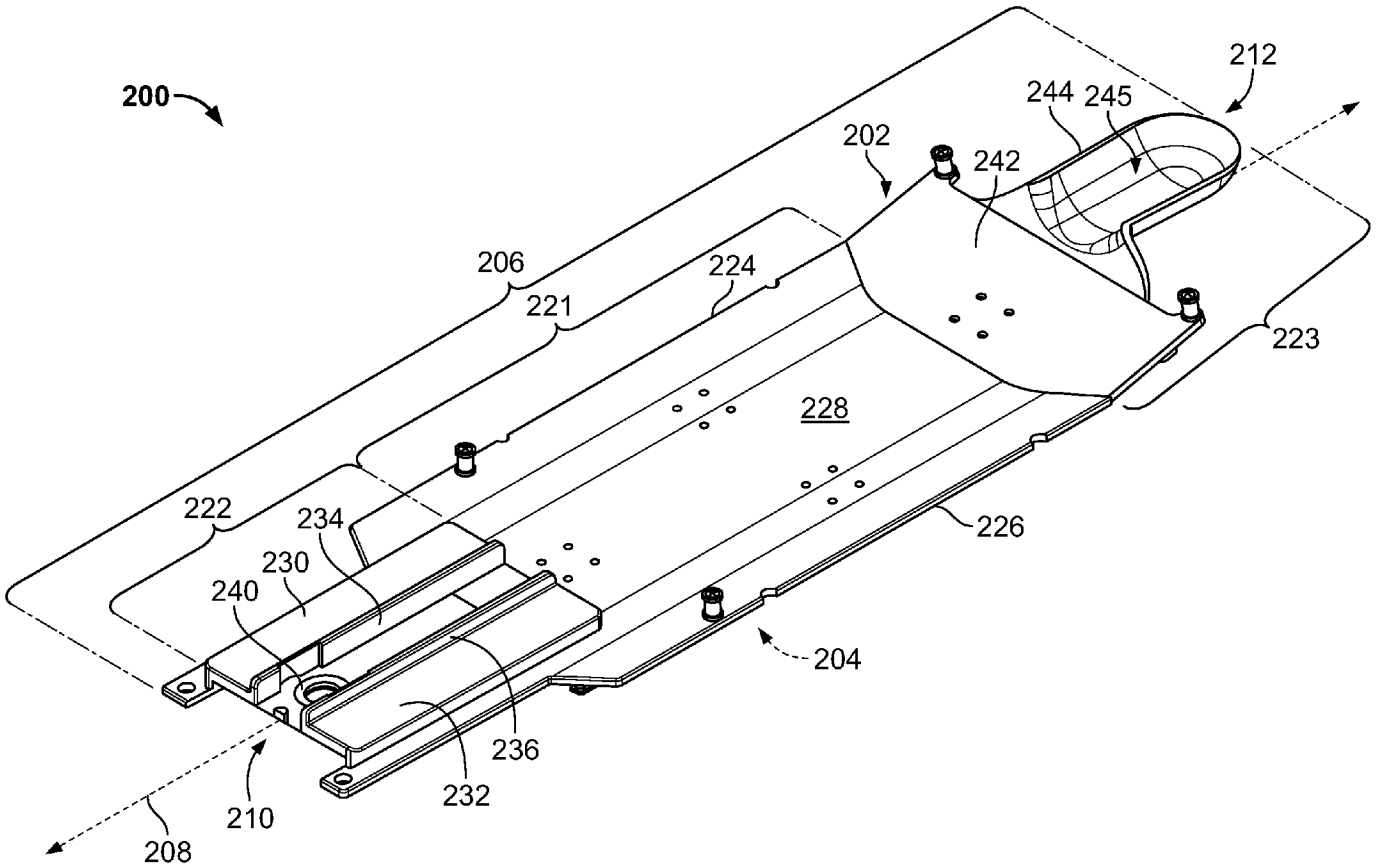
FIG. 2 is a top perspective view of a patient transfer board formed in accordance with one embodiment.
Figure 3:
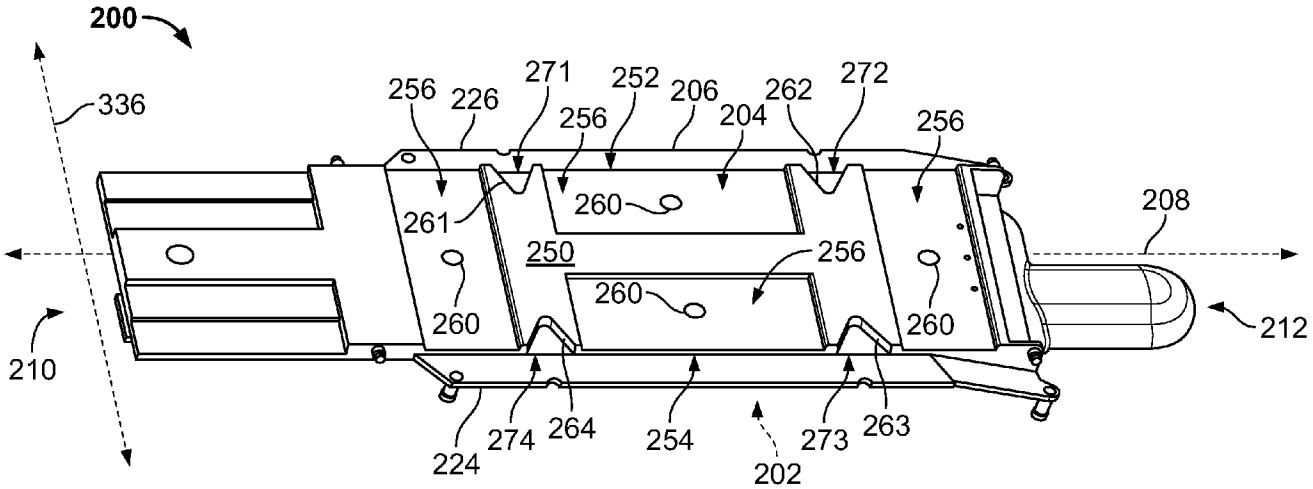
FIG. 3 shows a perspective view of an underside of the transfer board of FIG. 2.

FIGS. 2 and 3 are isolated perspective views of a patient transfer board 200 formed in accordance with one embodiment. FIG. 2 is a perspective view of a top side 202, and FIG. 3 is a perspective view of an underside 204. The transfer board 200 may be moved by a transporter (not shown), such as the transporter 100, between different medical imaging systems as described above with respect to the transfer board 114 (FIG. 1). The transfer board 200 includes an elongated board body 206 that extends lengthwise along a longitudinal axis 208. The top side 202 of the board body 206 is configured to face a patient, such as the patient 102, during a medical imaging or therapy session. The underside 204 is configured to face a patient table, such as the patient tables 134, 136 (FIG. 1), during the session. The board body 206 includes a leading (or first) end 212 and a trailing (or second) end 210. It should be noted that the terms leading and trailing are only used to distinguish the ends 210, 212 and do not limit an orientation of the transfer board 200 when the transfer board 200 is advanced into a gantry of an imaging system. For example, a patient may be moved head first into the gantry or feet first into the gantry.

With respect to FIG. 2, the board body 206 includes at least first, second, and third sections 221-223, which may also be referred to as a torso section 221, a leg section 222, and a head extension 223. The board body 206 has a patient surface 228 that extends along the torso section 221, the leg section 222, and the head extension 223. The torso section 221 is configured to support a torso of a patient during the session. The torso section 221 may be shaped to cradle or hold a patient on the top side 202. For example, the board body 206 may include first and second body wings 224, 226 that are on opposite side of the board body 206. In the illustrated embodiment, a majority of the body wings 224, 226 extend along the torso section 221. The body wings 224, 226 may extend away from patient surface 228 along the torso section 221 at non-orthogonal angles. As one example, the non-orthogonal angles formed between the body wings 224, 226 and the patient surface 228 may be about 30°.

The leg section 222 extends from the torso section 221 and includes the trailing end 210. As shown in FIG. 2, the leg section 222 includes first and second platforms 230, 232. Each of the leg platforms 230, 232 is configured to have one of the legs of the patient lie thereon. The leg platforms 230, 232 have a height that is above the patient surface 228 along the torso section 221. Each of the leg platforms 230, 232 includes an inner wall 234, 236, respectively.

In the illustrated embodiment, the board body 206 includes a gas port 240 that is positioned between the leg platforms 230, 232. The gas port 240 is configured to engage or mate with a pneumatic system (not shown) so that gas/air may be provided. The gas port 240 is fluidicly coupled with one or more conduits (not shown) that are, in turn, fluidiely coupled to support chamber 256 (shown in FIG. 3). The inner walls 234, 236 of the leg platforms 230, 232 may protect a hose or tube that is coupled to the gas port 240 from being inadvertently engaged. The leg platforms 230, 232 may also be configured to support an RF coil at least partially between the inner walls 234, 236, such as a Peripheral-Vascular (PV) RF coil. The RF coil could be installed and removed without moving the patient. The gas port 240 is accessed through the top side 202 along the leg section 222. However, in alternative embodiments, the gas port 240 may be positioned at other locations. For example, the gas port 240 may exist in the torso section 221 or the head extension 223. The gas port 240 may also be accessed through the underside 204.

The head extension 223 extends from the torso section 221 and includes the leading end 212. The head extension 223 may be configured to a hold at least a portion of the patient's shoulders and head. As shown, the head extension 223 includes first and second portions 242, 244. The first portion 242 is configured to hold the patient's shoulders and the second portion 244 is configured to hold the patient's head. Accordingly, the second portion 244 may also be referred to as a headrest. The first portion 242 forms a non-orthogonal angle (e.g., about 30°) with respect to the torso section 221. The second portion 244 includes a recess 245 configured to receive the patient's head.

As shown in FIG. 3, the underside 204 includes a support surface 250 that is configured to interface with patient tables and/or a transporter, such as the patient tables 134, 136 and the transporter 100 shown in FIG. 1. The underside 204 also includes a plurality of support chambers 256. As shown, each of the support chambers 256 may include at least one outlet port 260 that is fluidicly coupled to the gas port 240 (FIG. 2) through a conduit. The support chambers 256 are configured to hold inflatable membranes 258 (shown in FIG. 5) that are fluidicly coupled to the outlet ports 260. As such, the inflatable membranes 258 are fluidicly coupled to the gas port 240. As will be described in greater detail below, the inflatable membranes 258 are configured to receive gas (e.g., air) from a pneumatic system (not shown). The inflatable membranes 258 may have a deflated or inflated condition. In the inflated condition, the inflatable membrane 258 may clear the support surface 250 and press against a surface that the transfer board 200 rests upon. As shown, the support chambers 256 are evenly distributed about the underside 204 that corresponds to the torso section 221 (FIG. 2). The support surface 250 is substantially I-shaped.

The underside 204 also includes first and second side edges 252, 254. The side edges 252, 254 extend between the top side 202 and the underside 204 and extend lengthwise along the longitudinal axis 208. In the illustrated embodiment, the body wings 224, 226 may form part of the side edges 254, 252, respectively. In the illustrated embodiment, the side edges 252, 254 form part of the torso section 221 (FIG. 2).

In various embodiments, the underside 204 includes one or more alignment slots along at least one of the side edges 252, 254. For example, the illustrated embodiment includes alignment slots 261-264 that have respective openings 271-274. The alignment slots 261-264 are configured to receive reference elements (not shown) of the patient table through the respective openings 271-274 when the transfer board 200 is moved in a lateral direction along a lateral axis 336 that is generally transverse (e.g., perpendicular) to the longitudinal axis 208. In an exemplary embodiment, each of the alignment slots 261-264 is located between two support chambers 256.

Figure 4:
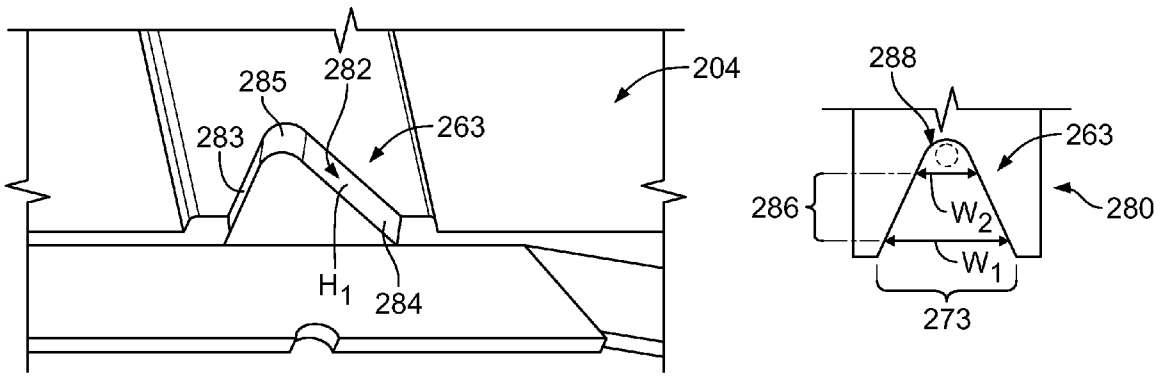
FIG. 4 is an enlarged view of an alignment slot that is located along the underside of the transfer board of FIG. 2.

FIG. 4 is an enlarged view of the alignment slot 263 that is located along the underside 204. FIG. 4 also illustrates a plan view 280 of the dimensions of the alignment slot 263. As shown in the enlarged view, the alignment slot 263 includes an interior sidewall 282 that defines the dimensions of the alignment slot 263. The interior sidewall 282 may include wall portions 283, 284 that substantially oppose each other.

The wall portions 283, 284 may join each other at a joint portion 285. In the illustrated embodiment, the interior sidewall 282 has a substantially uniform height $H_1$.

As shown in the plan view 280, the alignment slot 263 includes the opening 273, an element-directing portion 286, and a locked point 288. The locked point 288 may represent the point where a reference element (indicated as a dashed circle) is located when the transfer board 200 is in the designated position. The alignment slot 263 has a width dimension W that is measured along the longitudinal axis 208 (FIG. 3). In an exemplary embodiment, the width W of the alignment slot 263 may reduce as the associated reference element moves further into the alignment slot 263 from the opening 273 to the locked point 288. For example, the alignment slot 263 has a first width $W_1$ measured proximate to the opening 273 and a second width $W_2$ measured proximate to the locked point 288. The first width $W_1$ is greater than the second width $W_2$. The second width $W_2$ may have a similar size and shape as the reference element.

Figure 5:
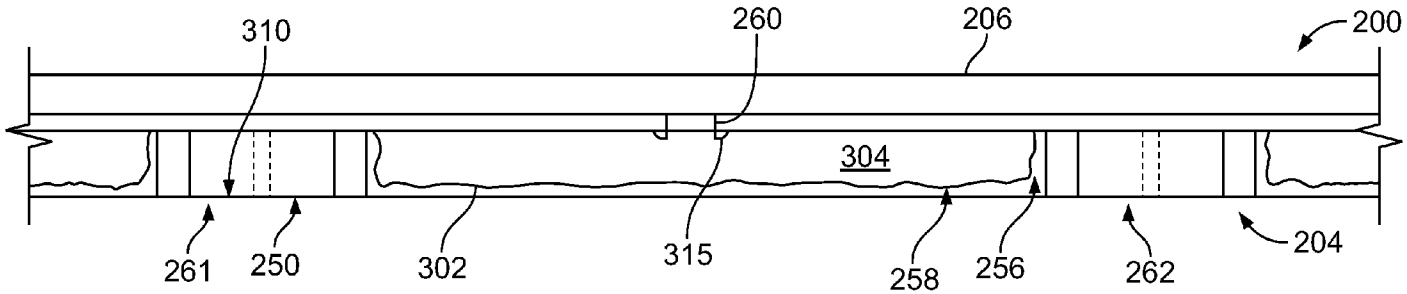
FIG. 5 is a side view of a portion of the underside when an inflatable membrane of the transfer board is in a deflated condition.
Figure 6:
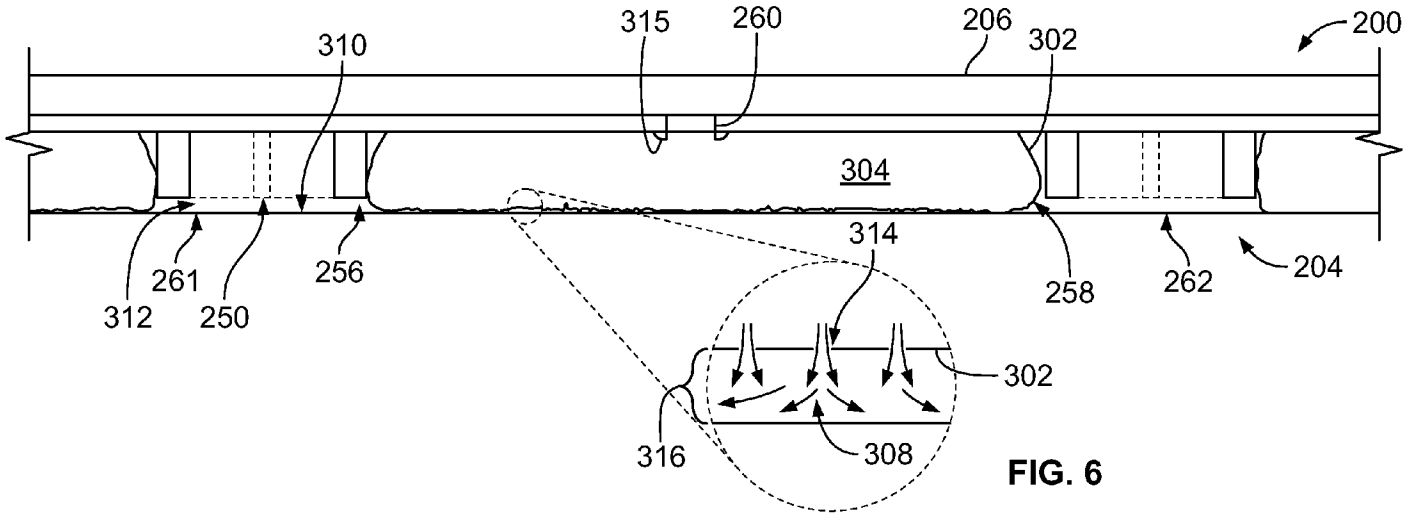
FIG. 6 is a side view of a portion of the underside when the inflatable membrane of the transfer board is in an inflated condition.

FIGS. 5 and 6 are side views of a portion of the underside 204 showing inflatable membranes 258 within support chambers 256. The inflatable membranes 258 are in a deflated condition in FIG. 5 and in an inflated condition in FIG. 6. As shown, the support chambers 256 are exposed to an exterior along the side edge 252. However, in alternative embodiments, the support chambers 256 may be completely surrounded by the underside 204 such that the support chambers 256 are only exposed from a bottom of the transfer board 200 when the transfer board is not resting on a surface. Also shown, at least one of the support chambers 256 and the corresponding inflatable membrane 258 are located between the alignment slots 261, 262 such that a line drawn parallel to the longitudinal axis 208 (FIG. 2) intersects each of the alignment slots 261, 262 and the inflatable membrane 258.

As shown in FIG. 5, when the inflatable membranes 258 are in the deflated condition, the support surface 250 may rest on a board-receiving surface 310. The board-receiving surface 310 may be, for example, the table surfaces 142 or 144 or a transporter surface. As the transfer board 200 rests on the board-receiving surface 310, it may be difficult to slide the transfer board 200 with a patient thereon due to frictional forces between the board-receiving surface 310 and the support surface 250.

With respect to FIG. 6, various embodiments utilize a pneumatic system (not shown) to inflate the inflatable membranes 258 to facilitate moving a patient on the transfer board 200 from one area to another. The inflatable membranes 258 comprise a flexible wall or sheet 302 that forms a reservoir or air pocket 304. The inflatable membranes 258 may also have inlets 315 that are configured to fluidicly couple to the corresponding outlet port 260. As the inflatable membranes 258 receive pressurized gas (e.g., pressurized ambient air) in the reservoir 304, the board body 206 is lifted by the inflatable membranes 258 such that a gap 312 exists between the support surface 250 and the board-receiving surface 310.

As shown in the enlarged portion of FIG. 6, the flexible wall 302 may include pores 314 in some embodiments. The pores 314 may allow pressurized gas 308 within the reservoir 304 to flow therethrough into the exterior or ambient surrounding. The escaped pressurized gas 308 may form an air interface 316 between the flexible wall 302 of the inflatable membrane 258 and the board-receiving surface 310. The air interface 316 substantially reduces the friction between the transfer board 200 and the board-receiving surface 310 thereby allowing the patient to be more easily transferred from the board-receiving surface 310 to another surface.

Figure 7:
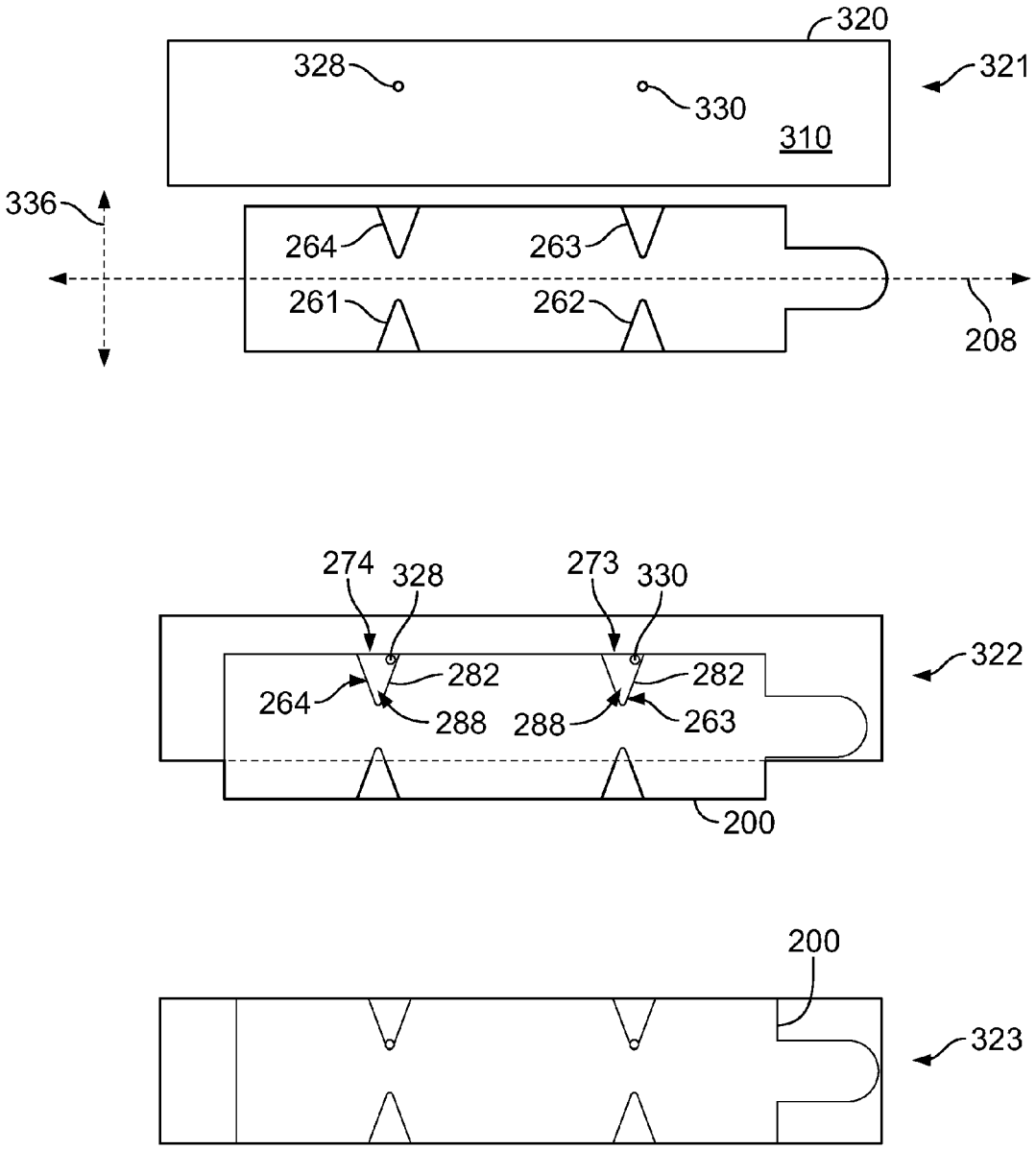
FIG. 7 is a schematic representation of different transfer stages.

FIG. 7 is a schematic representation of the transfer board 200 and a base insert 320 during transfer stages 321-323. The base insert 320 includes the board-receiving surface 310 and reference elements 328, 330 attached thereto. The reference elements 328, 330 are affixed or secured to the base insert 320 and are configured to withstand the lateral forces that are experienced when engaging the transfer board 200. For example, the reference elements 328, 330 may be metal, plastic, or rubber materials that are screwed, bolted, or otherwise secured to the base insert 320. The reference elements 328, 330 may also be secured through a frictional engagement (e.g., interference fit). The reference elements 328, 330 are sized and shaped relative to the alignment slots that engage the reference elements 328, 330. In some embodiments, the reference elements 328, 330 may be removably secured to the patient tables.

In the illustrated embodiment, the base insert 320 is removable from the patient table or the transporter. For example, the base insert 320 may constitute a panel that is dimensioned to rest upon the patient table or the transporter. The panel may have top and bottom surfaces in which the bottom surface rests on the patient table or the transporter. In alternative embodiments, the base insert 320 may be part of a patient table or a transporter such that the base insert 320 is not removably mounted to the patient table or the transporter. Furthermore, the reference elements 328, 330 may be secured directly to the patient table or the transporter without the use of a base insert.

The transfer stages 321-323 include a board-positioning stage 321, an alignment stage 322, and a final stage 323. In the board-positioning stage 321, the transfer board 200 is relatively positioned laterally adjacent to (e.g., side-by-side) to the patient table or the transporter having the base insert 320. As used herein "relatively positioned" means the transfer board 200 may be moved to be adjacent to the base insert 320 or the base insert 320 may be moved to be adjacent to the transfer board 200. At the board-positioning stage 321, the alignment slots 264, 263 are approximately aligned with the reference elements 328, 330, respectively, with respect to the lateral axis 336. In embodiments that include the inflatable membranes 258 (FIG. 5), the pneumatic system may be activated to provide pressurized air to the reservoirs 304 (FIG. 5) of the inflatable membranes 258 thereby inflating the membranes 258. The inflatable membranes 259 may lift the transfer board 200 off of the board-receiving surface 310 and/or provide the air interface 316 between the board-receiving surface 310 and the transfer board 200. In this manner, an individual may more easily slide the transfer board 200 in a lateral direction along the lateral axis 336 and generally transverse to the longitudinal axis 208 (FIG. 2).

However, in alternative embodiments, an individual may use other mechanisms to facilitate moving the transfer board 200. For example, the board-receiving surface 310 and/or the support surface 250 (FIG. 3) may be modified to substantially reduce the friction between the surface and the transfer board 200. In other embodiments, a rail assembly may be used in which the transfer board 200 slides from one position to the next position using a plurality of rails.

During the alignment stage 322, the reference elements 328, 330 clear the openings 274, 273, respectively, and advance into the alignment slots 264, 263, respectively. In the illustrated embodiment, if the transfer board 200 is moving in a misaligned manner, the reference elements 328, 330 engage the interior sidewalls 282 of the respective alignment slots 264, 263. More specifically, if the transfer board 200 is moving in a direction such that the reference elements are not moving relatively toward the locked points 288, the reference elements 328, 330 will engage the interior sidewalls 282. The interior sidewalls 282 and the reference elements 328, 330 effectively redirect the transfer board 200 so that the transfer board 200 is moved toward the designated position at the final stage 323. At the final stage 323, the transfer board 200 is positioned at a designated axial position and at a designated lateral position with respect to the patient table or the transporter.

In an exemplary embodiment, the alignment slots 261-264 are triangular and the reference elements 328, 330 are cylindrical. However, the alignment slots 261-264 and the reference elements 328, 330 may have other dimensions in other embodiments. For example, the alignment slots may be frustro-conical or the wall portions 283, 284 may have arched or curved contours. The reference elements 328, 330 may be cubed or rectangular. Moreover, in some embodiments, more than one reference element may be inserted into a single alignment slot. In such embodiments, each of the reference elements may be positioned at a separate locked point in the one alignment slot.

Figure 8:
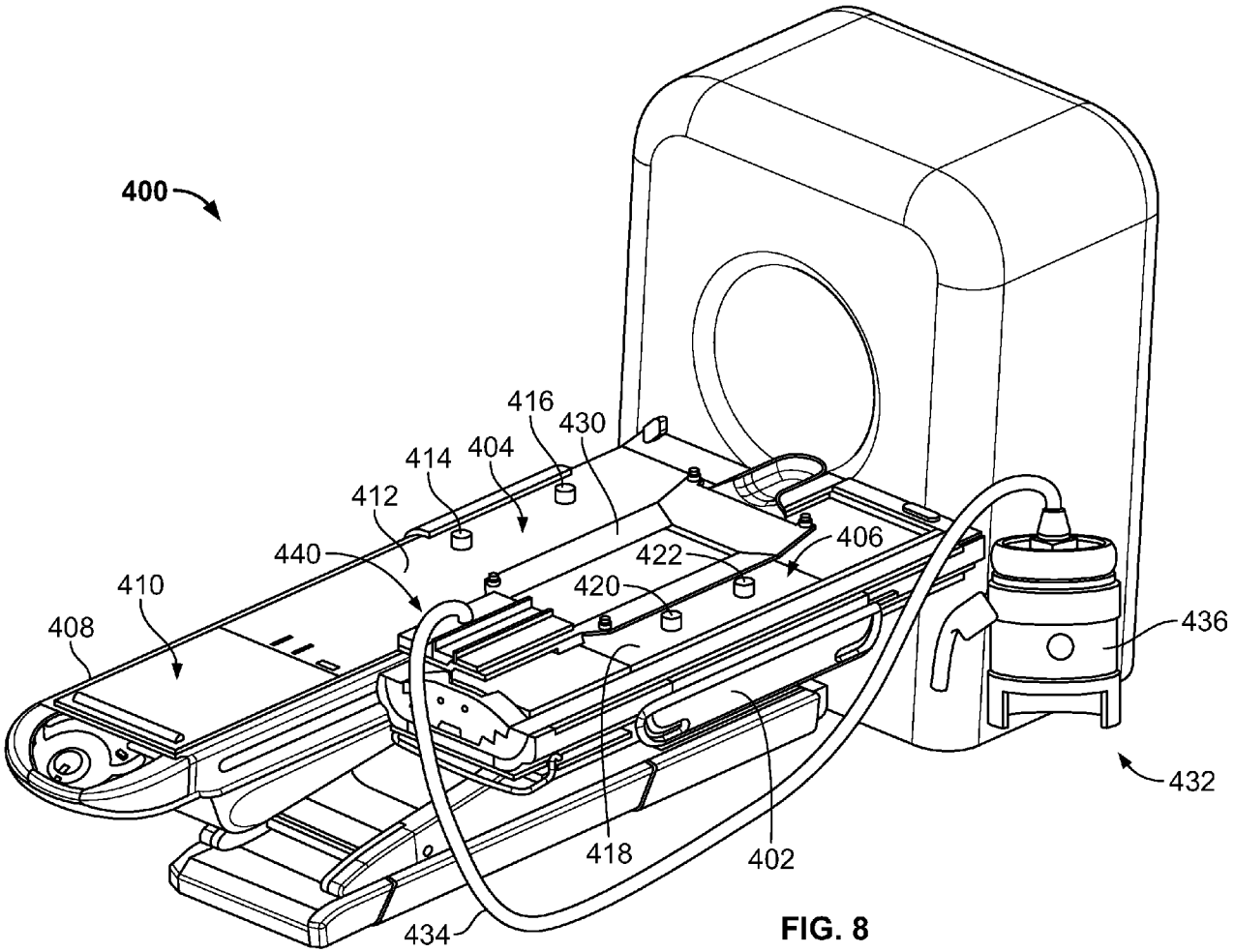
FIG. 8 is a perspective view of a medical imaging system and a transporter having a transfer assembly in accordance with one embodiment.

FIG. 8 is a perspective view of a medical imaging system 400 and a transporter 402 utilizing a patient transfer assembly 404 in accordance with one embodiment. The transporter 402 may be a detachable MR table. In the illustrated embodiment, the imaging system 400 is a PET/CT dual-modality imaging system, although embodiments described herein may be used with other modalities. The imaging system 400 includes a patient table 408 having a table surface 410. In FIG. 8, a portion of the table surface 410 is defined by a base insert 412 that has reference elements 414, 416. The transporter 402 includes a transporter surface 406. At least a portion of the transporter surface 406 is defined by a base insert 418 having reference elements 420, 422.

The transfer assembly 404 includes a transfer board 430 that is configured to support a patient thereon. The transfer board 430 may be identical to the transfer board 200. The transfer assembly 404 may also include a pneumatic system 432. The pneumatic system 432 includes a conduit 434, which is illustrated as a flexible hose in FIG. 8, and an air blower 436. In the illustrated embodiment, the air blower 436 is separate from the transporter 402 and the transfer board 430. However, in alternative embodiments, the air blower 436 may be attached to the transporter 402 or to the transfer board 430. The conduit 434 is fluidicly coupled to a gas port 440 of the transfer board 430. The air blower 436 is fluidicly coupled to one or more inflatable membranes (not shown), such as the inflatable membrane 258, through the conduit 434 and the gas port 440. When the air blower 436 is activated, the inflatable membrane(s) lift the transfer board 430 thereby assisting an individual in moving the transfer board 430 along the transporter surface 406 and the table surface 410.

Figure 9:
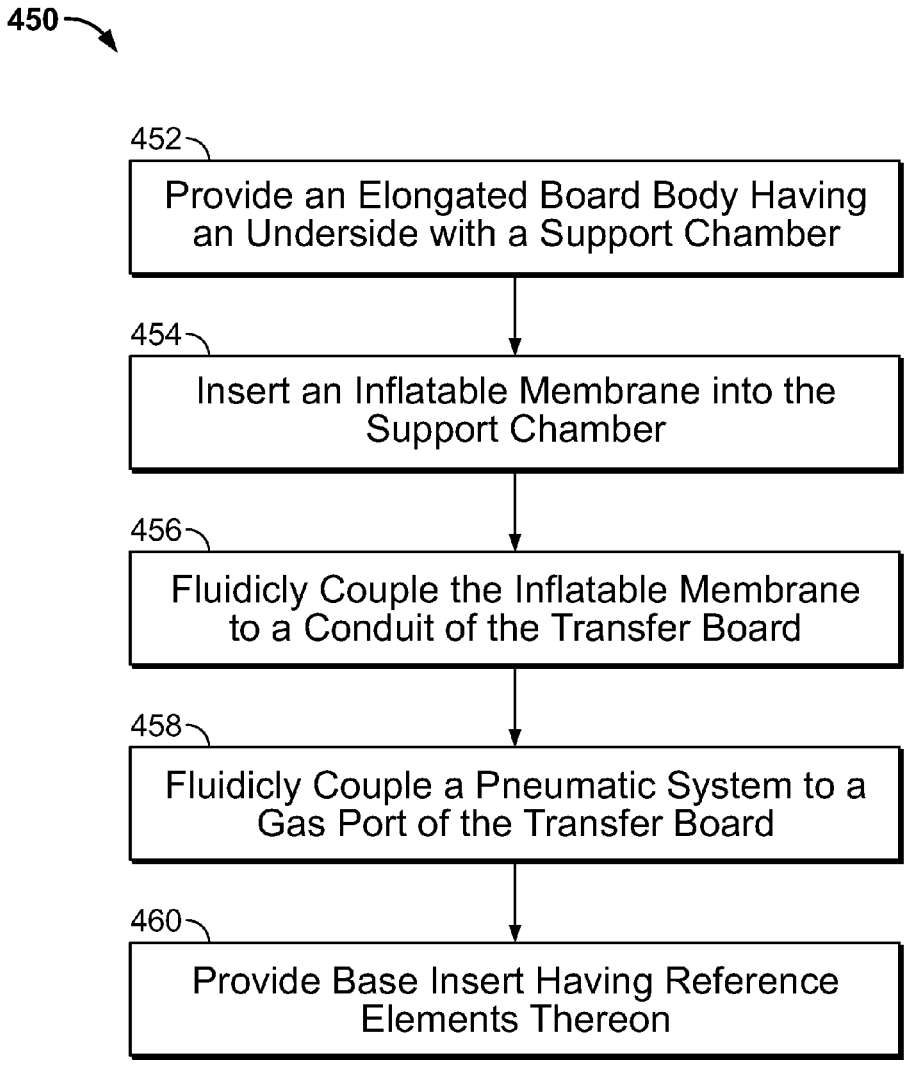
FIG. 9 is a flowchart illustrating a method of manufacturing a transfer board and a transfer assembly.

FIG. 9 is a flowchart that illustrates a method 450 of manufacturing a patient transfer board, such as the transfer board 200 or 430. The method 450 includes providing at 452 an elongated board body that extends lengthwise along a longitudinal axis. The board body may include a gas port and a conduit that is fluidicly coupled to the gas port. The board body may also have a top side and an underside. The underside may include a support chamber that opens to a patient table and an alignment slot having a side opening. The alignment slot may be defined by an interior sidewall. The alignment slot may be configured to receive a reference element of the patient table through the opening when the transfer board is moved in a lateral direction that is generally transverse to the longitudinal axis.

The method 450 also includes inserting at 454 an inflatable membrane into the support chamber. The inflatable membrane may have an inlet and a reservoir. The inflatable membrane may be configured to inflate when a flow of air is provided to the reservoir. The method 450 may also include fluidicly coupling at 456 the inflatable membrane to a conduit of the transfer board so that the inflatable membrane is fluidicly coupled to the gas port.

In some embodiments, the method 450 may also be a method for manufacturing a patient transfer assembly. In such embodiments, the method 450 may include fluidicly coupling at 458 a pneumatic system to the gas port. The pneumatic system may include an air blower and a conduit that fluidicly couples the air blower to the gas port. In some embodiments, the method 450 may also include providing at 460 a base insert having one or more reference elements thereon.

Thus, in one embodiment, a patient transfer board is provided that includes an elongated board body extending lengthwise along a longitudinal axis between leading and trailing ends of the board body. The transfer board also includes a top side of the board body configured to face and hold a patient during a medical imaging or therapy session. The transfer board also includes an underside of the board body that is configured to face a patient table during the session. The underside includes first and second side edges that extend along the longitudinal axis. The underside includes alignment slots having respective openings at the first side edge. The alignment slots being defined by interior sidewalls. The alignment slots are configured to receive reference elements of the patient table through the respective openings when the transfer board is moved in a lateral direction that is generally transverse to the longitudinal axis. The sidewalls are configured to engage the corresponding reference elements and direct the transfer board toward a designated position.

In one aspect, each of the alignment slots has a width measured along the longitudinal axis that reduces as the associated reference element moves further into the alignment slot from the opening. For instance, each of the alignment slots may have first and second widths measured along the longitudinal axis. The first width is measured proximate to the corresponding opening, and the second width is measured proximate to where the associated reference element is located when the transfer board is in the designated position. The first width is greater than the second width.

In one aspect, the alignment slots are first alignment slots. The transfer board may also include second alignment slots having respective openings at the second side edge.

In one aspect, the underside includes a plurality of support chambers that open to the patient table. The transfer board may also include a gas port that is configured to fluidicly couple to a pneumatic system. The board body may include conduits that fluidicly couple the gas port and the support chambers. The transfer board may also include inflatable membranes that are located within corresponding support chambers. The inflatable membranes are configured to receive gas from a pneumatic system. The inflatable membranes are configured to press against a surface of the patient table when in an inflated condition.

In another aspect, the transfer board may be part of a transfer assembly. The transfer assembly may also include a base insert having a board-receiving surface with the reference elements thereon. The board-receiving surface may be configured to have the transfer board slide thereon.

In another embodiment, a patient transfer board is provided that includes an elongated board body extending lengthwise along a longitudinal axis between leading and trailing ends of the board body. The board body includes a gas port and a conduit that is fluidicly coupled to the gas port. The board body may have a top side configured to face and hold a patient during a medical imaging or therapy session, and an underside configured to face a patient table during the session. The underside may include a support chamber that opens to the patient table and an alignment slot having an opening. The alignment slot may be configured to receive a reference element of the patient table through the opening when the transfer board is moved in a lateral direction that is generally transverse to the longitudinal axis. The transfer board may also include an inflatable membrane that is located within the support chamber and fluidicly coupled to the gas port. The inflatable membrane may have a reservoir and be configured to inflate when gas is provided to the reservoir.

In another aspect, the transfer board may be part of a transfer assembly that includes a pneumatic system fluidicly coupled to the gas port of the transfer board. The pneumatic system may include an air blower that is configured to provide the gas to the reservoir.

It is to be understood that the above description is intended to be illustrative, and not restrictive. For example, the above described embodiments (and/or aspects thereof) may be used in combination with each other. In addition, many modifications may be made to adapt a particular situation or material to the teachings of the invention without departing from its scope. For example, the ordering of steps recited in a method need not be performed in a particular order unless explicitly stated or implicitly required (e.g., one step requires the results or a product of a previous step to be available). While the dimensions and types of materials described herein are intended to define the parameters of the invention, they are by no means limiting and are exemplary embodiments. Many other embodiments will be apparent to those of skill in the art upon reviewing and understanding the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A patient transfer board comprising:

an elongated board body extending lengthwise along a longitudinal axis between leading and trailing ends of the board body;

a top side of the board body configured to face and hold a patient during a medical imaging session; and an underside of the board body configured to face an imaging table during the medical imaging session, the underside including first and second side edges that extend along the longitudinal axis, the underside includes alignment slots having respective openings at the first side edge, the alignment slots being defined by interior sidewalls, wherein the alignment slots are configured to receive reference elements of the imaging table through the respective openings when the transfer board is moved in a lateral direction that is generally transverse to the longitudinal axis, the sidewalls configured to engage the corresponding reference elements and direct the transfer board toward a designated position, wherein the underside includes a plurality of support chambers that open to the imaging table and are configured to have corresponding inflatable membranes located therein.

2. The transfer board of claim 1, wherein each of the alignment slots has first and second widths measured along the longitudinal axis, the first width being measured proximate to the corresponding opening and the second width being measured proximate to where the associated reference element is located when the transfer board is in the designated position, the first width being greater than the second width.

3. The transfer board of claim 1, wherein each of the alignment slots has a width measured along the longitudinal axis that reduces as the associated reference element moves further into the alignment slot from the opening.

4. The transfer board of claim 1, wherein the board body includes a torso section configured to support a torso of the patient, the alignment slots being located along the torso section.

5. The transfer board of claim 1, wherein the alignment slots are first alignment slots, the transfer board further comprising second alignment slots having respective openings at the second side edge.

6. The transfer board of claim 1, further comprising a gas port configured to fluidicly couple to a pneumatic system, the board body including conduits that fluidicly couple the gas port and the support chambers.

7. The transfer board of claim 1, further comprising the inflatable membranes located within the corresponding support chambers, the inflatable membranes configured to receive gas from a pneumatic system, wherein the inflatable membranes are configured to press against a surface of the imaging table when in an inflated condition.

8. The transfer board of claim 1, further comprising a transfer assembly that includes the transfer board, wherein the transfer assembly further comprises a base insert, the base insert having a board-receiving surface with the reference elements thereon, the board-receiving surface configured to have the transfer board slide thereon.

9. A patient transfer board comprising:

an elongated board body extending lengthwise along a longitudinal axis between leading and trailing ends of the board body, the board body including a gas port and a conduit that is fluidicly coupled to the gas port;

a top side of the board body configured to face and hold a patient during a medical imaging session;

an underside of the board body configured to face an imaging table during the medical imaging session, the underside includes:

a support chamber that opens to the imaging table an alignment slot having an opening, wherein the alignment slot is configured to receive a reference element of the imaging table through the opening when the transfer board is moved in a lateral direction that is generally transverse to the longitudinal axis; and an inflatable membrane located within the support chamber and fluidicly coupled to the gas port, the inflatable membrane having a reservoir, the inflatable membrane configured to inflate when gas is provided to the reservoir.

10. The transfer board of claim 9, further comprising a transfer assembly that includes the transfer board, the transfer assembly including a pneumatic system fluidicly coupled to the gas port of the transfer board, the pneumatic system including an air blower that is configured to provide the gas to the reservoir.

11. The transfer board of claim 9, wherein the alignment slot has a width measured along the longitudinal axis that reduces as the reference element moves further into the alignment slot from the opening.

12. The transfer board of claim 9, wherein the board body includes a torso section configured to support a torso of the patient, the alignment slot being located in the torso section.

13. The transfer board of claim 9, wherein the underside includes a plurality of the alignment slots, the alignment slots opening in a same direction.

14. The transfer board of claim 9, further comprising a transfer assembly that includes the transfer board and a removable base insert, the base insert having a board-receiving surface with the reference element thereon, the board-receiving surface configured to have the transfer board slide thereon.

15. A method of manufacturing a patient transfer board, the method comprising:

providing an elongated board body that extends lengthwise along a longitudinal axis, the board body including a gas port and a conduit that is fluidicly coupled to the gas port, the board body including a top side and an underside, the underside configured to face an imaging table during a medical imaging session, wherein the underside includes:

a support chamber that opens to the imaging table;

an alignment slot having an opening, the alignment slot being defined by an interior sidewall, wherein the alignment slot is configured to receive a reference element of the imaging table through the opening when the transfer board is moved in a lateral direction that is generally transverse to the longitudinal axis;

inserting an inflatable membrane into the support chamber, the inflatable membrane having an inlet and a reservoir, the inflatable membrane configured to inflate when gas is provided to the reservoir; and fluidicly coupling the inflatable membrane to the conduit so that the inflatable membrane is fluidicly coupled to the gas port.

16. The method of claim 15, further comprising providing a pneumatic system having an air blower and fluidicly coupling the air blower to the gas port.

17. The method of claim 15, wherein the alignment slot has a width measured along the longitudinal axis that reduces as the reference element moves further into the alignment slot from the opening.

18. The method of claim 15, wherein the board body includes a torso section configured to support a torso of the patient, the alignment slot being located in the torso section.

19. The method of claim 15, wherein the underside is includes a plurality of the alignment slots, the alignment slots opening in a same direction.

* * * * *